United States Patent [19]

Sagefors et al.

[11] Patent Number: 4,708,523

[45] Date of Patent: Nov. 24, 1981

[54] ROCK CAVITY

[75] Inventors: Karl I. Sagefors, Öregrund; Per G. Persson, Ytterhogdal, both of Sweden

[73] Assignee: Boliden Aktiebolag, Stockholm, Sweden

[21] Appl. No.: 871,398

[22] PCT Filed: Sep. 18, 1985

[86] PCT No.: PCT/SE85/00357

§ 371 Date: May 16, 1986

§ 102(e) Date: May 16, 1986

[87] PCT Pub. No.: WO86/01854

PCT Pub. Date: Mar. 27, 1986

[30] Foreign Application Priority Data

Sep. 20, 1984 [SE] Sweden ..... 8404728

[51] Int. Cl.[4] ..... B63G 5/00

[52] U.S. Cl. ..... 405/55; 405/128; 405/53

[58] Field of Search ..... 405/53, 55, 128

[56] References Cited

U.S. PATENT DOCUMENTS

| | | | |
|---|---|---|---|
| 1,347,934 | 7/1920 | Brown | 405/55 |
| 3,068,654 | 12/1962 | Warren . | |
| 3,701,262 | 10/1972 | Connell et al. | 405/53 |
| 3,925,992 | 12/1975 | Bäckström | 405/53 |
| 4,363,563 | 12/1982 | Hallenius et al. . | |
| 4,572,707 | 2/1986 | Sagefors . | |

FOREIGN PATENT DOCUMENTS

| | | | |
|---|---|---|---|
| 3335044 | 4/1985 | Fed. Rep. of Germany | 405/53 |
| WO85/04751 | 10/1985 | PCT Int'l Appl. | 405/128 |
| 149372 | 3/1955 | Sweden | 405/53 |
| 660335 | 11/1951 | United Kingdom | 405/53 |

*Primary Examiner*—Richard J. Scanlan, Jr.
*Assistant Examiner*—Anthony Knight
*Attorney, Agent, or Firm*—Burns, Doane, Swecker & Mathis

[57] ABSTRACT

A rock cavity for storing fluids, solid products for some other purpose, such as the protected manufacture or production of goods, comprising a substantially vertical, cylindrical rock cavity comprising a conical top section (14), and a conical or horizontal bottom section (15) and a vertical section (1) extending therebetween and presenting in cross-section a polygonal shape, wherewith vertical shafts (11) are located in at least half the corners of the polygon.

5 Claims, 11 Drawing Figures

ROCK CAVITY

TECHNICAL FIELD

The present invention relates to a method for constructing cavities in rock formations, and particularly, although not exclusively, vertical cylindrical cavities intended for storing in rock petroleum products, or other fluids, or solid products, such as chemicals, chemical waste, radioactive waste, and other materials which are suited for storage in rock cavities.

The object of the present invention is to provide such a method which will enable vertical cylindrical cavities to be constructed, blasted, in rock formations with the minimum explosive effect on residual cavity walls, while observing maximum safety conditions with respect to the working environment of the personnel involved in the construction of these cavities.

BACKGROUND PRIOR ART

It is previously known to store petroleum products, and also other liquids lighter than water, in a cavity formed in groundwater carrying rock formations, in which the stored liquid lies in direct contact with the water-permeable surface of the cavity walls. The pressure exerted on the cavity walls by the liquid stored in the cavity is lighter than the pressure exerted by surrounding groundwater, thereby counteracting any tendency of the stored liquid to pass through the wall.

When the stored liquid is lighter than water and insoluble therein, it is a normal practice to provide a water bed in the lowermost region of the cavity.

SE-A-7802027-8 and 7901278-7 describe and illustrate complexes for storing petroleum products and other fluids in rock formations. These storage complexes, or locations, have a very high storage capacity, despite being of relatively small horizontal extension. The stored product is therewith located within a concentrated area, and the expedient of shielding the storage area with a curtain of densely packed, waterfilled drill holes can therefore be more readily carried out, thereby to off-set lowering of the groundwater level and preventing the stored product from spreading to the complex surroundings.

According to these patent specifications, the cavities are located at substantially mutually equal depths, and when seen in horizontal section each cavity has a substantially circular or oval shape, and when seen in horizontal cross-section throughout the whole of the complex the mean points of the circular or oval horizontal sections of respective cavities lie in the corners of regular polygons, all having the same number of sides.

By regular polygon is meant a polygon in which all sides are of mutually equal length and all corner angles are the same. A regular polygon can thus be inscribed in a circle which passes through all of the corner points and the centre of which thus also forms the centre of the polygon.

In accordance with one embodiment of the invention these polygons have the form of various sized pentagons having a common centre point. The cavities are therefore arranged in concentric circles. A further cavity can be arranged so that its centre axis coincides with the centre point of these circles.

It is also known from SE-A-8300185-9 to construct in rock formations a fluid-storage cavity location in which the actual cavity has the form of a substantially vertical cylinder, around which there is provided a series of vertical holes forming a water-drainage shield; this drainage shield is intended for removal of the water bed upon which the stored fluid has rested.

Present day rock cavities for storing oil or petroleum products have the form of long "loaves", i.e. horizontally extending rock cavities presenting a bottom surface area of 500×25 m or thereabove, and a height of 30 m. It has been found that when storing oil products in rock cavities of this kind, in which the oil rests on a bed of water, microorganisms grow in the boundary layer between water and oil, the oil/oil products being destroyed thereby and rendered worthless for future use. When such cavities are used to store refined products, it has been found necessary to re-refine the products in order to guarantee their usefulness.

In order to overcome these problems associated with horizontal cavities, the use of vertical, substantially cylindrical rock cavities has been proposed, as beforementioned. Examples of such vertical cavities are described and illustrated in SE-A-7901278-7 and SE-A-8300185-9, and in subsequent articles by K. I. Sagefors et al, WP-System, Stockholm, Sweden. When excavating the rock in the construction of such vertical cavities, there is first formed a top tunnel from which the conically shaped roof cupola is taken, by first drilling holes oliquely outwards and downwards in the vicinity of the peripheral surface of the ultimate cupola or roof structure, filling these holes with explosives and blasting the rock; forming one or more transport tunnels so that said tunnels open into the cylindrical peripheral surface of the ultimate vertical rock cavity, excavation of rock being effected from the transport tunnels by vertical drilling and bench excavation operations, the shot rock-mass being taken-out at the bottom, which may taper conically downwards to a separate removal tunnel, which can be used for introducing piping and like conduits into the cavity site, and for removing goods stored in the cavity.

As mentioned above, previous methods for constructing substantially cylindrical, vertical cavities from rock formations have involved driving a top tunnel from which drilling takes place. This necessitates the provision of a large number of drill holes and therewith an excessive charge of explosives, which places the roof of the cavity under unnecessary strain. Construction of the top tunnel also results in disturbance of the rock located above the cavity, with subsequent risk of impaired strength.

Upon discovery that microorganisms grow in the boundary layer between the product stored and the water present, it was demanded that any water present should be kept to a minimum, and it was further proposed in conjunction herewith that the cavity walls be coated with an imprevious composite lining comprising multi-layers of shotcrete, reinforced shotcrete, epoxy resin, glass fibre fabrics, and additionally epoxy resin. One such cavity-lining method is described by Beckers-Sigman, COLTURIET products.

It is not certain, however, that a lining of this nature would be able to provide durable protection should the lining be subjected constantly to water pressure on the rock side thereof. Consequently, in order to guarantee prolonged resistance of the lining, additional methods have been proposed for eliminating ambient water (SE-A-8300185-9).

It has been found that bench blasting has a highly deleterious affect on the residual cavity wall, and hence it is necessary, at high costs, to bolt the cavity wall and to line the same in order to achieve a durable result. Bench blasting also results in the formation of microfissures through which water in surrounding rock can enter the cavity.

Bench blasting also presents a serious risk to the working environment of those responsible for drilling the holes.

For reasons of a technical and environmental nature, there has now been raised a demand for a new method of excavating vertical rock cavities.

DISCLOSURE OF THE PRESENT INVENTION

It has been found that the present invention surprisingly meets all of these demands. The method according to the invention is characterized by constructing from a transport tunnel an upper circumferential tunnel of larger external diameter than the diameter of the substantially cylindrical part of the ultimate rock cavity, at a level above the highest ceiling level of said ultimate cavity; forming from a second transport tunnel a lower circumferential chamber of larger external diameter than the diameter of the substantially cylindrical part of the ultimate rock cavity at a level which lies not higher than the ultimate level of the lowermost point of the ultimate rock cavity; connecting these circumferential chambers by excavating a central vertical shaft and by excavating at least three vertical shafts at the periphery of the ultimate cavity; ring drilling horizontally from the central shaft into the central rock mass in the ultimate cavity; fan drilling horizontal holes in the outer rock mass in the ultimate cavity, from the vertical peripheral shafts, so as to form a polygon of drill holes in a horizontal section through the ultimate rock cavity; drilling angled holes from the said peripheral shafts in a manner to form a conical roof arch and/or a conical base profile; and by blasting from the bottom upwards in a consecutive series of blasting operations, to form a polygonal, vertical rock cavity.

These and other characteristic features of the invention are set forth in the following claims.

When excavating cavities in rock formations in accordance with the invention, serious crack formations are less likely to occur in the cavity walls. In addition, all drilling work is effected from the vertical shafts; the drillers are located in the protection of the shafts and therefore need never enter the cavity. Blasting can be effected from below, wherewith the drillers can quickly re-take their working position in the shafts.

The invention will now be described in more detail with reference to the accompanying drawings, in which FIG. 1 illustrates in horizontal section a preferred embodiment of a rock cavity constructed in accordance with the invention;

FIGS. 5–11 illustrate various sequences in constructing the cavity from rock formations, wherein FIG. 5 illustrates the drilling of holes from the central shaft;

FIG. 6 illustrates the drilling of finer holes in the outer part, and the drilling of drainage holes from the peripheral shafts;

FIG. 7 illustrates the scaling of the cavity walls with water under high pressure;

FIG. 8 illustrates the step of spraying the cavity walls with shotcrete;

FIG. 9 illustrates the introduction of a platform into the central shaft;

FIG. 10 illustrates the step of spraying the cavity walls with a synthetic resin composition; and FIG. 11 illustrates inspection of the drainage system.

Figure 2:
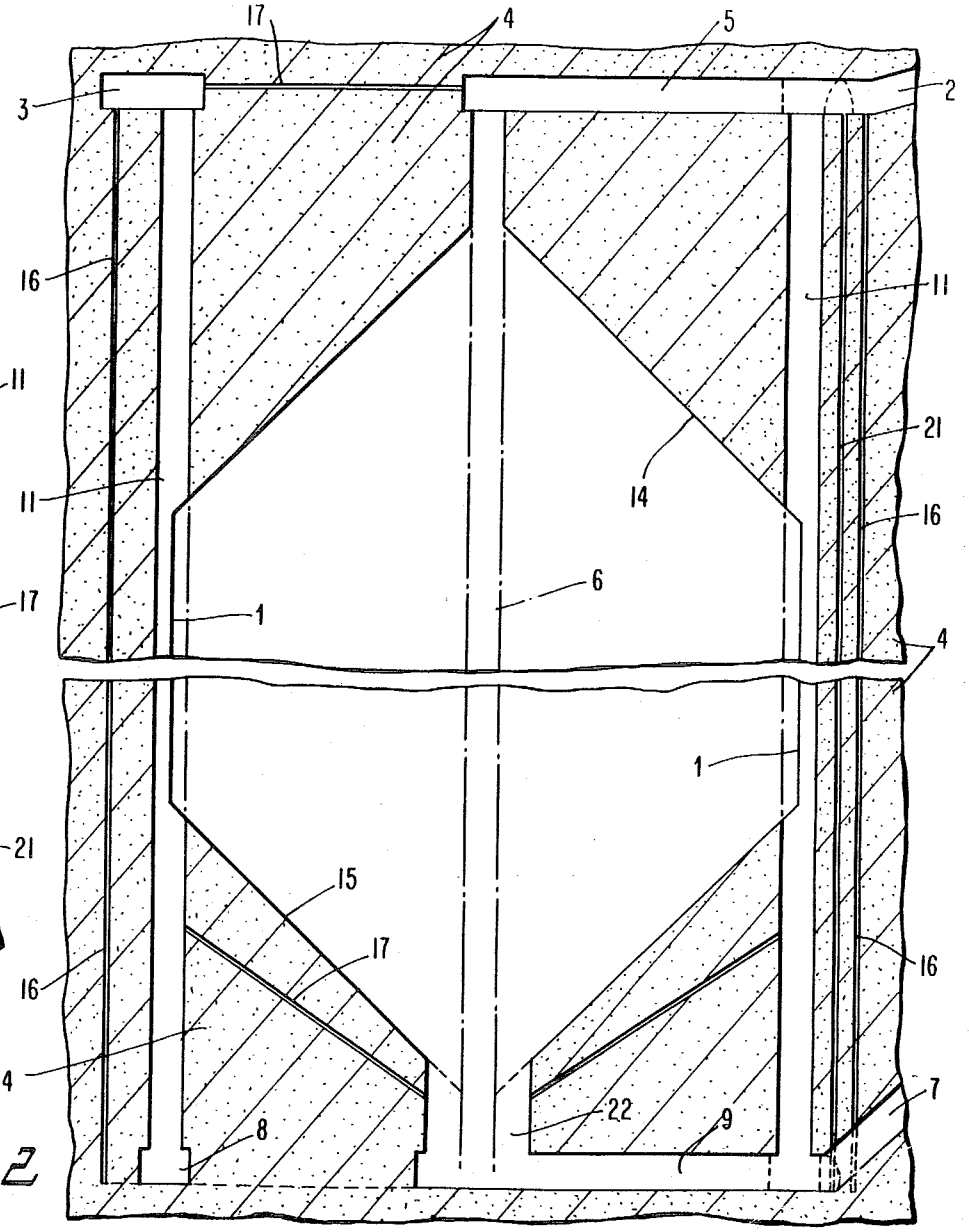
FIG. 2 is a vertical sectional view of the embodiment illustrated in FIG. 1.

In the drawings the reference 1 identifies the periphery of an ultimate, substantially cylindrical and vertical cavity excavated from rock. When seen in horizontal section, the rock cavity has a polygonal cross-sectional form (in some cases a decagonal form). The ultimate outer contours of the cavity are shown in black, heavy lines, while the lighter drawn, full or broken lines show the cavity contours during construction. A transport tunnel 2 opens into an annular chamber 3, the diameter of which, or at least its outer diameter, is greater than the diameter of the ultimate rock cavity (30–40 m), said chamber 3 being constructed from the transport tunnel 2. In the residual core mass 4 located within the annular chamber or tunnel 3 there is now formed a tunnel 5 which extends to a vertical shaft 6 intended for use as a waiting adit for horizontal/slightly sloping ring drilled holes in the rock mass to be blasted in the excavation of the rock cavity. When constructing the transport tunnel 2 there is formed at the same time a second transport tunnel 7 which extends to the bottom level of the ultimate rock cavity. A second annular tunnel 8 is excavated from this second transport tunnel 7 and the central vertical shaft 6 is joined to the second annular tunnel 8 by means of a horizontal tunnel 9. Side chambers 10 are excavated from the upper annular tunnel 3, inwardly of the rock mass. In the illustrated embodiments, three or six vertical shafts 11 are formed between the side chambers 10 and the lower annular tunnel 8, these shafts being formed by tunnel boring upwards from below.

This method involves drilling a narrow hole from above and downwards. A tunnel boring bit is connected in the tunnel 8 to a wire which extends through the hole and which during drilling is drawn from the bottom of the hole upwards. When the drill bit has reached the top of the once narrow hole and the shaft has thus been completed, the drill bit is lowered to the bottom of the shaft and moved to the site of the next shaft, whereafter the procedure is repeated.

As beforementioned, holes 12 are ring drilled from the shaft 6 horizontally into the rock mass to be blasted. In this case there is used a relatively coarse drill, diameter 10 cm, and drilling is continued to a distance of about 5 m from the ultimate cavity wall (40 times the hole diameter in centimeters). Horizontal holes 13 are fan drilled from the shaft 11 into the rock mass which is to be blasted out and which has not been perforated from the centre. These holes are drilled with finer drills, e.g. drills of 20–40 mm in diameter. The outermost drill holes 13*a* are instrumental in forming the inner wall of the ultimate rock cavity. These relatively fine holes are not normally drilled to distances in excess of 10 m, since it is difficult to control the self-steering of the drill at distances greater than this. Consequently the sides of the polygon are seldom longer than 10 m.

Holes which are instrumental in shaping the ceiling or roof structure 14 and the floor structure 15 of the cavity are drilled from the shaft 11. These holes are drilled from said shaft obliquely upwards and obliquely downwards at an angle of from 45°–60°.

The holes are filled with blasting explosives upon completion of a hole-drilling sequence. The drill holes extending outwardly from the central vertical shaft are filled with heavy explosive charges, whereas the holes drilled in the outer ring of rock-mass are charged with a lighter querlite explosive charge, 11–17 mm in diameter.

Blasting is effected successively downwards, the rock is scaled and the shot rock-mass is taken out through the tunnel 9 with the aid of skips or front loaders.

As soon as a blasting salvo has terminated, platforms can be automatically lowered down the vertical shafts, whereafter the fallen rock debris can be sprayed with water from water cannons, to bind all dust. This significantly reduces the risk of silicosis.

In order to seal-off the rock-mass externally of the cavity complex, vertical holes 16 are drilled from the upper annular tunnel 3 straight down through the rock-mass, to the level of the cavity bottom. A sealing agent is then injected into these holes, so as to fill the micro-cracks and macro-cracks in the rock-mass.

Subsequent to excavating the complete cavity, the rock-mass can be readily sealed, by lowering lift or elevator platforms carrying high-pressure spray equipment down the peripheral shafts.

When desiring a more imprevious surface, the rock-mass can be treated with shotcrete from the same lift or elevator platforms as those used to scale the rock surfaces.

In certain cases, when storing fuel for civilian and military jet aircraft, totally impervious surfaces are required, so as to totally eliminate the presence of water. In this case the cavity walls are coated with a synthetic resin composite, from a collapsible/extendable platform structure, which is lowered down from the mouth of the central shaft and which comprises working platforms from which work can be carried out.

In order to eliminate the water pressure exerted by water in the surrounding rock-mass, it is necessary to drain this water away. This is effected by drilling drainage holes 17 in the rock-mass from the peripherally located vertical shafts 11. The drill holes 17 are placed so close together that water moving towards the rock cavity is captured and carried away thereby. The holes 17 slope slightly downwards towards the vertical shafts 11 and discharge thereinto. The drainage water runs behind a wall 18 cast in respective vertical shafts 11, and can therewith be readily pumped away from the bottom of said shafts. Elevators can be mounted in the remaining part of the shafts 11, so that the shafts can be monitored with respect to water drainage.

Figure 1:
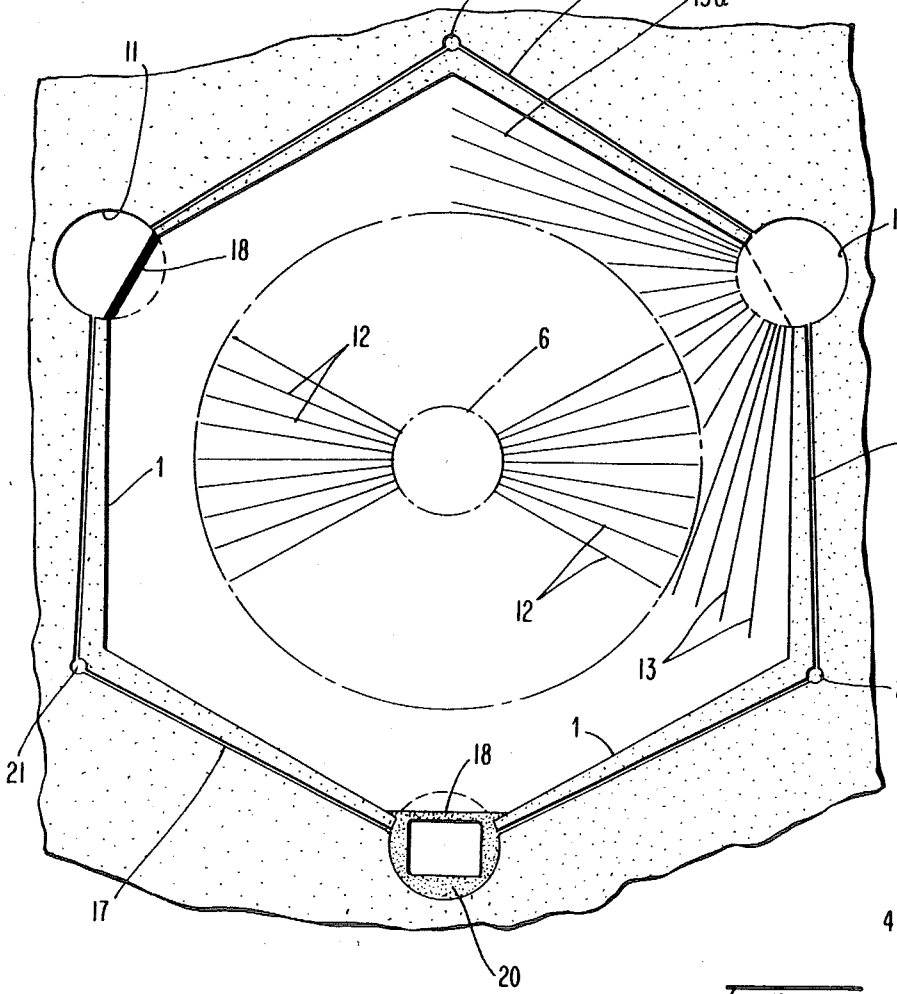

Alternatively, when blasting is completed, the vertical shafts can be filled with a concrete construction, as illustrated in FIG. 1 by the reference 20. In this case the drainage pipes are led out through the concrete construction. It will be understood that FIG. 1 only illustrates a few of the total number of drill holes required for blasting at each level.

The drainage holes 17 drilled behind the cavity walls 1 may suitably be connected vertically at each corner of a polygon where no vertical shaft is located, by means of vertical holes 21. These vertical holes 21 may also be used to blow hot air through the drainage holes 17 in groups or sections, and in this way dry/heat the cavity wall prior to applying the synthetic resin lining thereto.

In order to drain the ceiling region of the cavity, drainage holes 17 are suitably drilled from the annular tunnel 3 at ceiling level, in towards the centre, as illustrated in FIG. 2. Conversely, for the purpose of draining the bottom region of the cavity an umbrella of drainage holes 17 is drilled from the centrally located rock chute 22 outwardly to an area externally of the cavity wall. Drainage water can be removed from the rock chute 22 via pipes not shown.

The vertical shafts may comprise an active storage part of the overall storage facility, or may alternatively play no part therein, depending on the type of fluid to be stored. When storing jet fuel these shafts play no active storage part, and hence there is introduced into the rock chute above the drainage area a bottom structure through which pipes (not shown) are drawn for pumping away the jet fuel. When storing crude oil, the whole of the tunnel and shaft system may form active storage locations, in which case there is inserted in the tunnel 7 a plug through which oil-pumping pipes are drawn.

Figure 4:
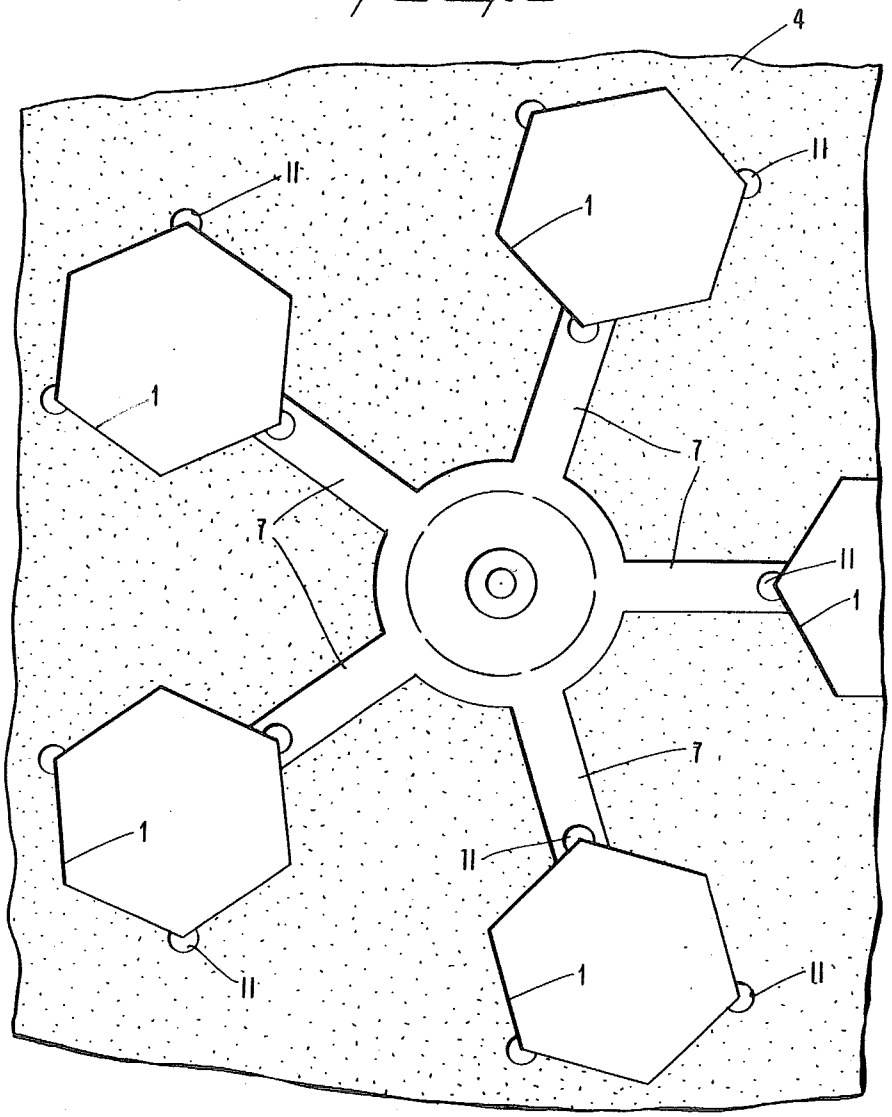
FIG. 4 is a horizontal sectional view of a complex comprising a plurality of rock cavities according to FIGS. 1–3.
Figure 3:
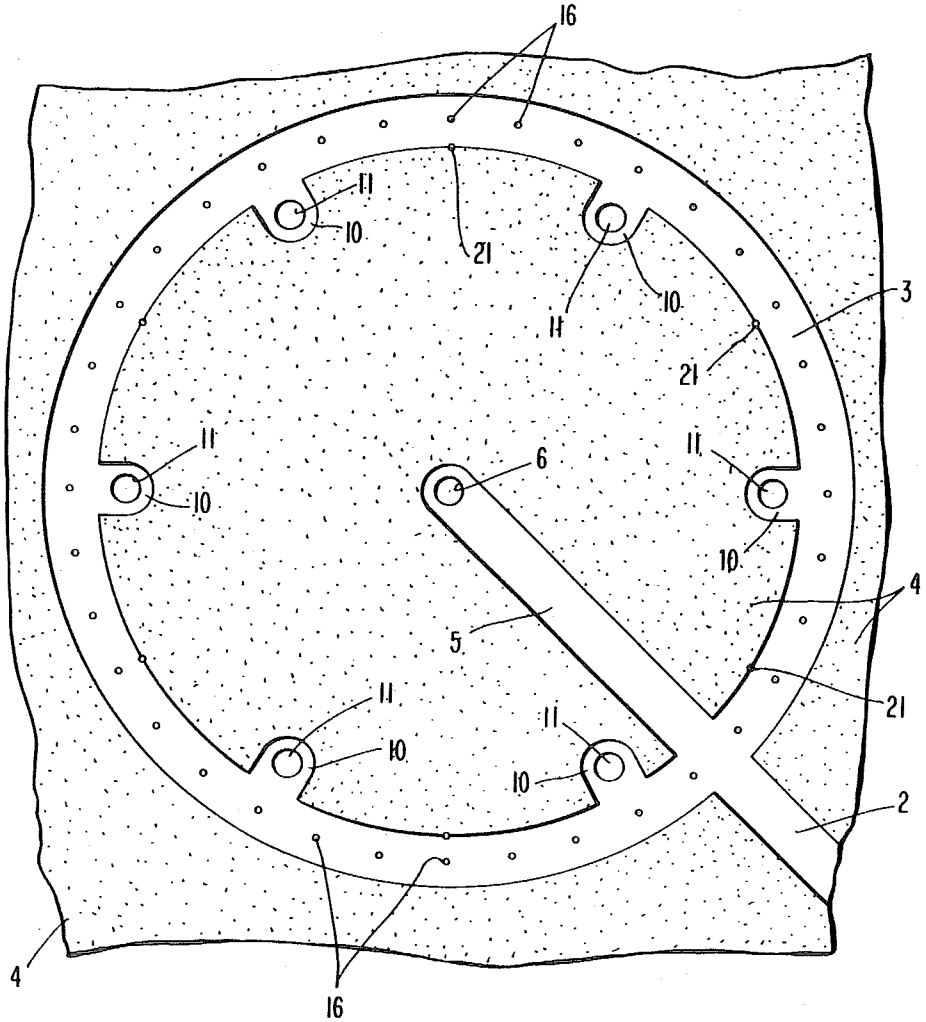
FIG. 3 is a horizontal sectional view of the upper part of the rock facility according to FIG. 1.
Figure 5:
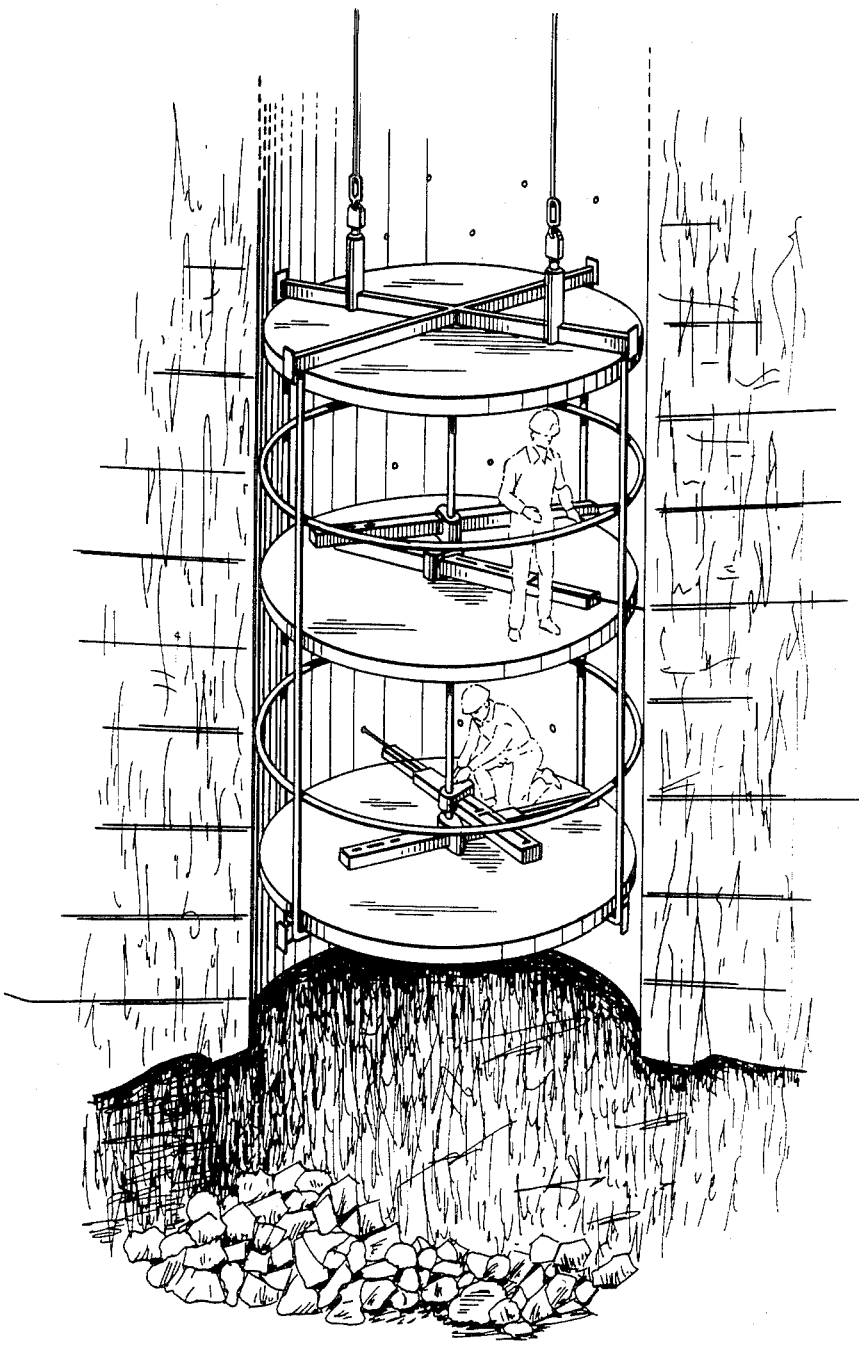
Figure 7:
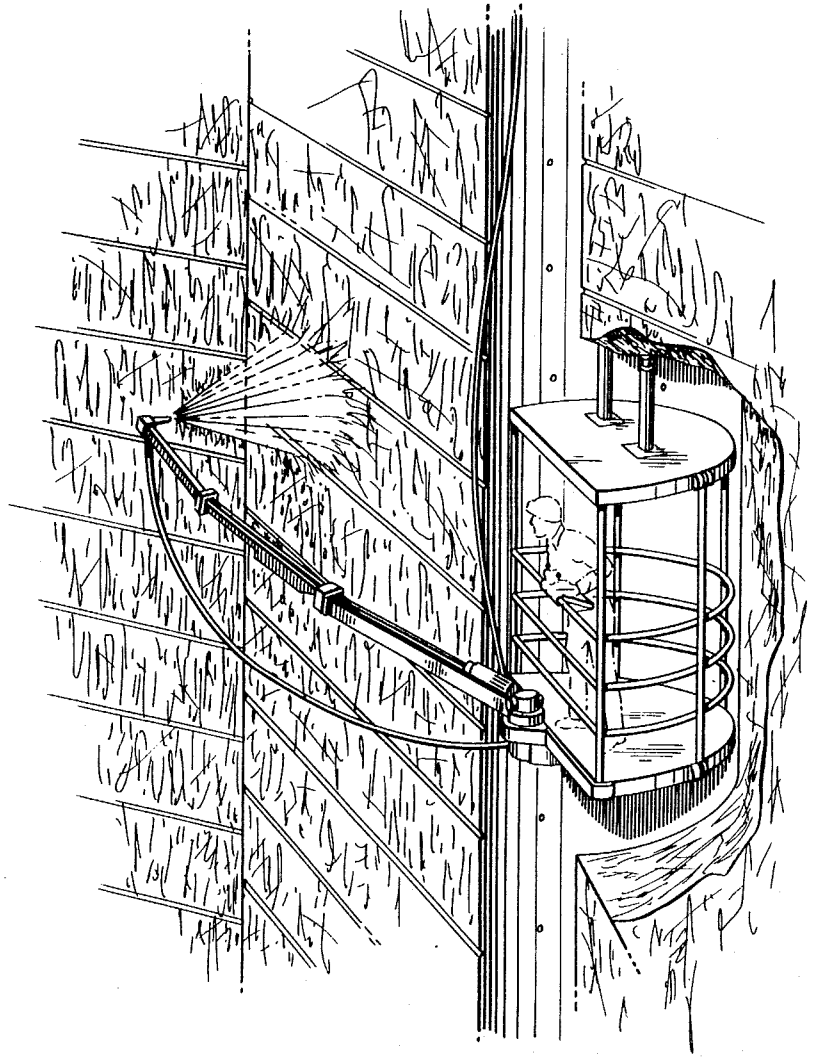
Figure 6:
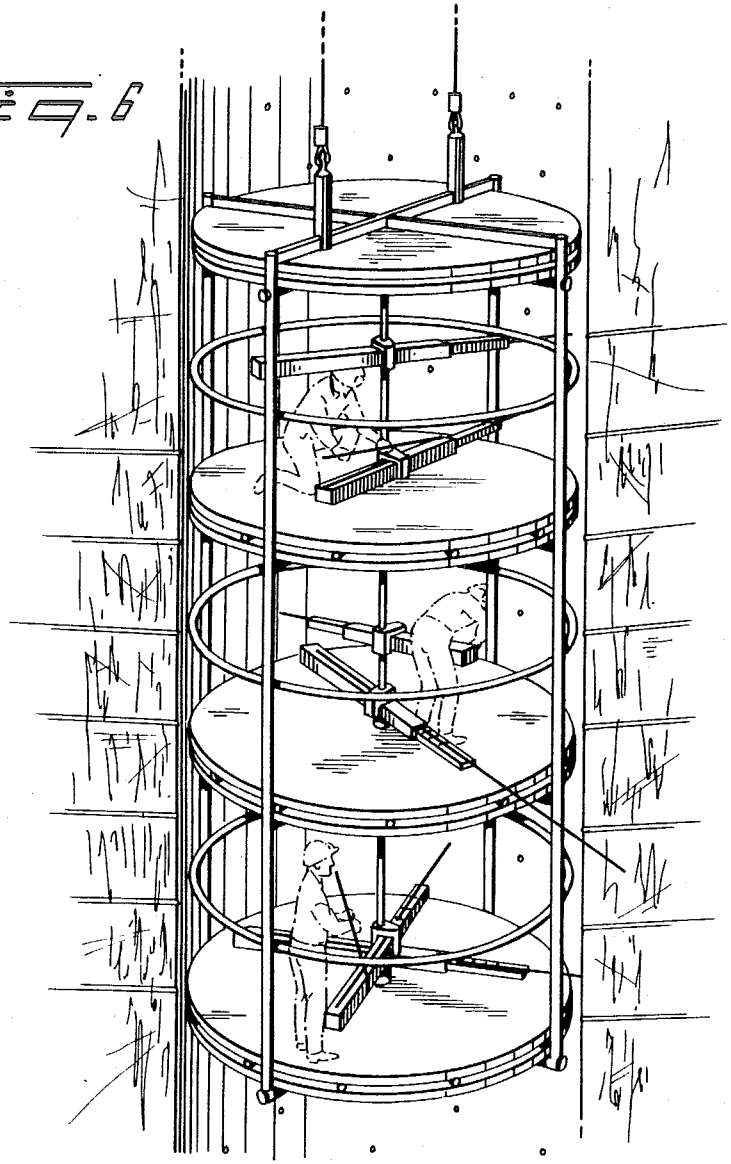
Figure 9:
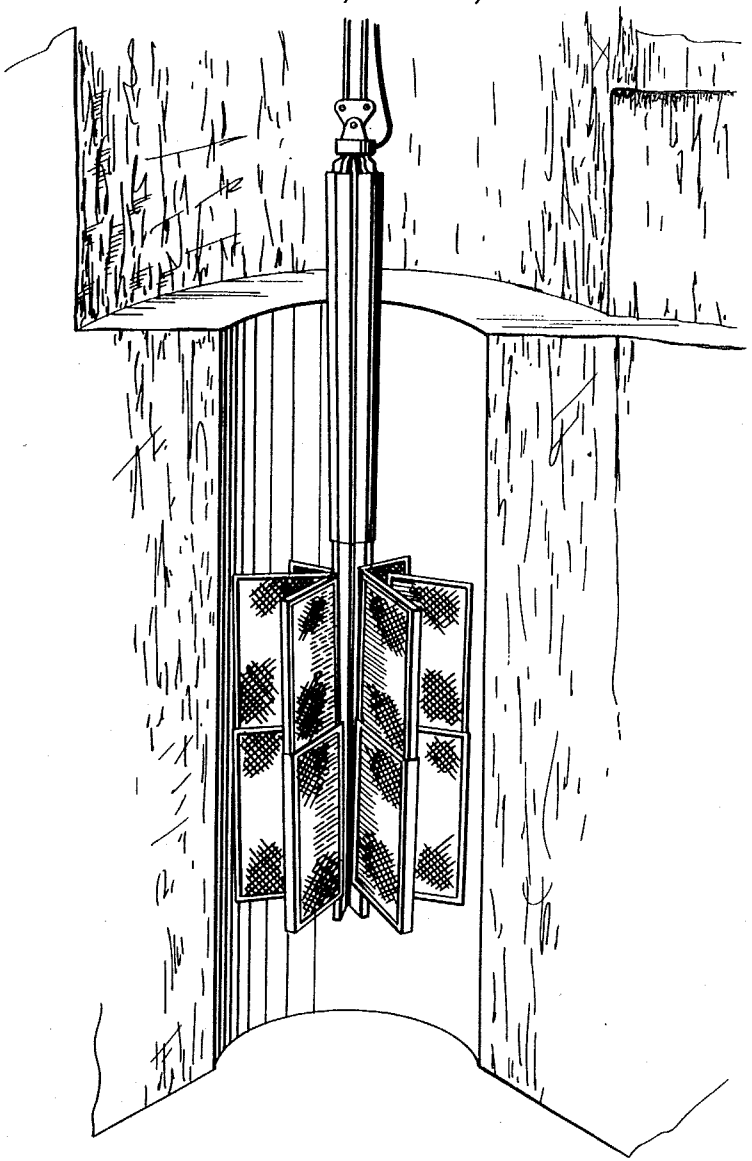
Figure 8:
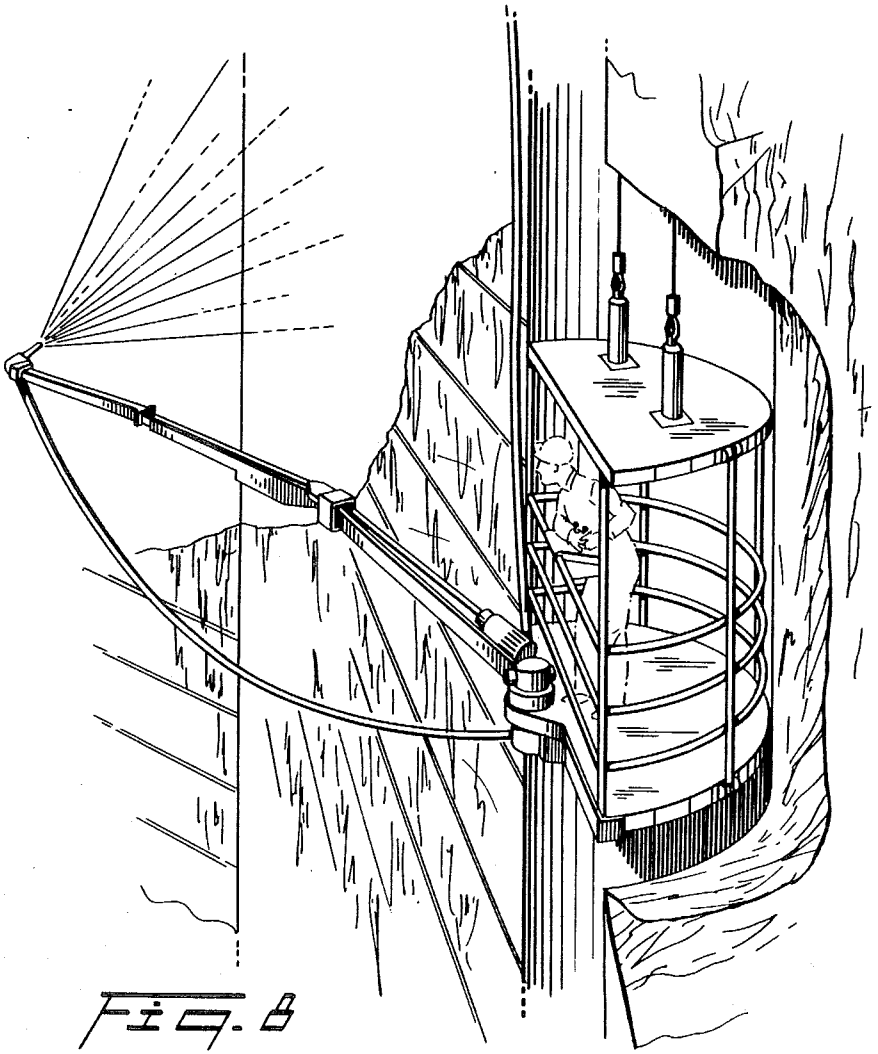
Figure 11:
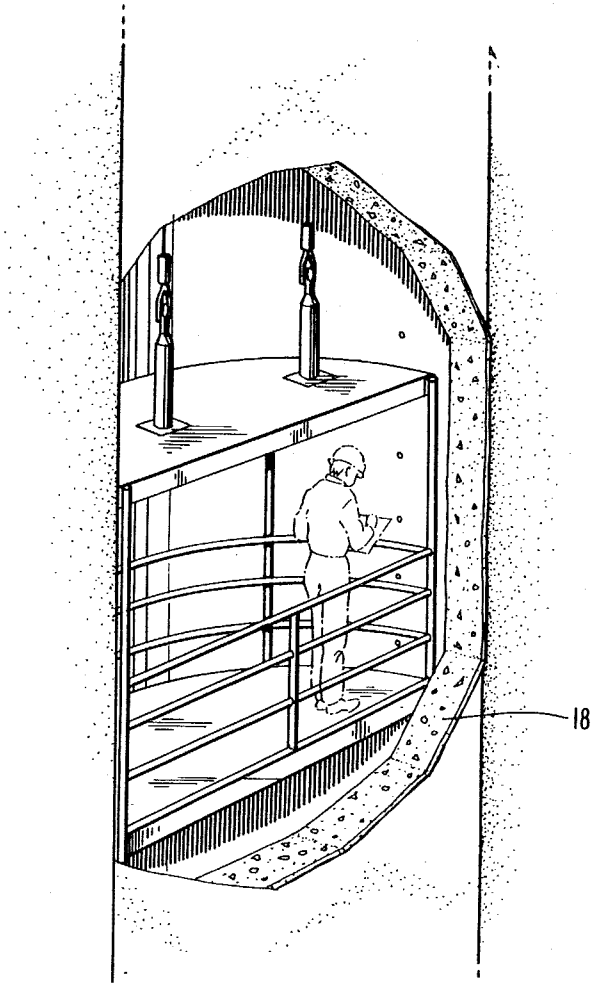
Figure 10:
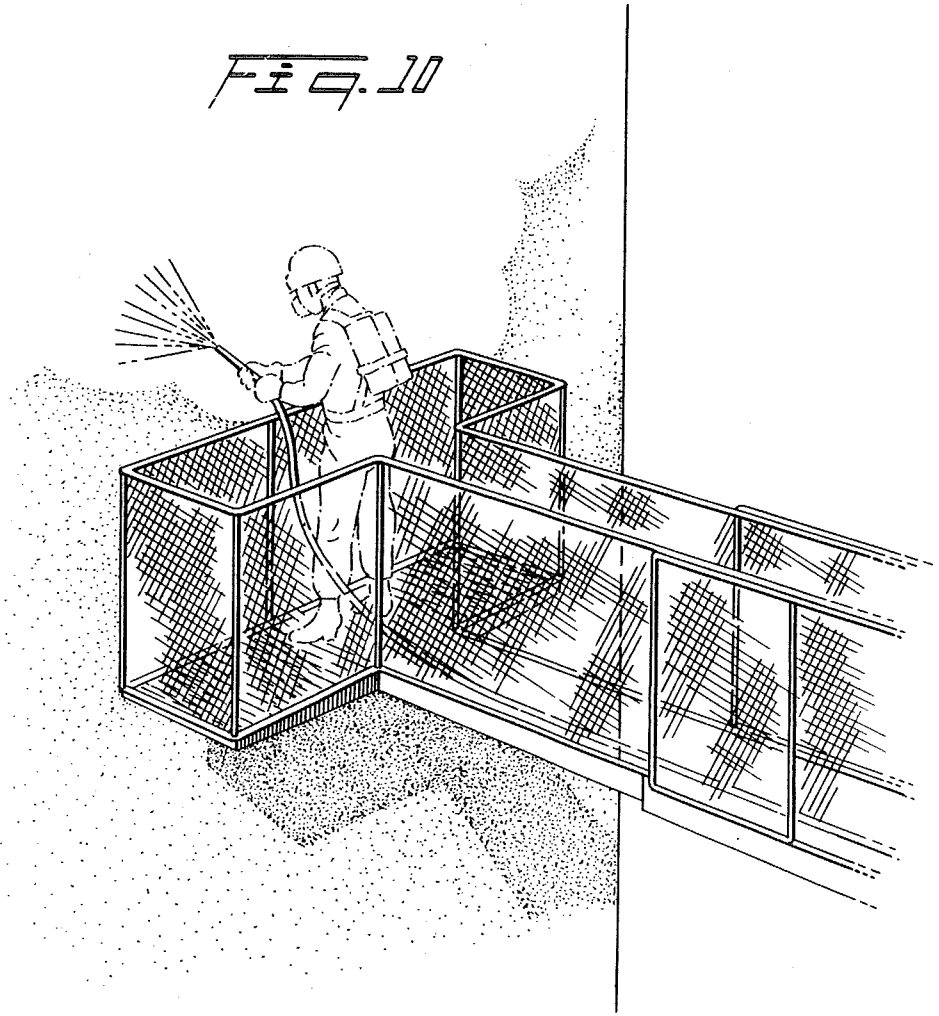

The complex illustrated in FIG. 4 thus includes a plurality of polygonal cavities formed in the rock-mass, each of these cavities having a substantially cylindrical shape, and each cavity forming a storage space, the rock-formed walls of which directly absorb the pressure exerted by the fluid stored in the cavity, the centre axes of the cavities extending vertically. Each cavity suitably has a vertical height which is greater than or equal to its diameter in cross-section.

The storage complex is compact and requires the minimum of surface area. It is thus possible to construct very large storage complexes within limited areas. The area of the storage region is minimal. This greatly facilitates provision of those means required to avoid lowering of the ambient ground water. The geometric configuration of the storage complex also facilitates provision of water curtains externally of the storage complex. These water curtains comprise rows of vertical drill holes filled with water. The groundwater level can be maintained within the storage complex and externally thereof with the aid of such water curtains. The fact that the storage complex can be constructed within a compact area enables the complex to be readily excavated from a homogenous rock-mass, thereby avoiding disturbances in the surroundings more readily.

Since each cavity has a height which is greater than its diameter, the rock-mass in which the complex is constructed can be utilized more favorably to great depths, which enables a more compact storage complex to be constructed and a more favorable economy to be achieved with regard to the use of available ground area, and also provides improved heat economy when the stored product is heated.

As a result of the considerable height of respective cavities, the head obtained is sufficient to enable the product to be readily pumped away with the aid of pumps arranged beneath said cavities. The compact design of the storage complex also means that the requisite pipe installations will be less expensive than would otherwise be the case.

If the stored product is to be heated, this heat can be supplied to any desired part of the cavities at any desired level.

If the stored products deposit slime or sludge, the sludge can readily be collected and pumped away from the storage complex, and it is not necessary to arrange large collecting spaces for the final deposition of sludge in the bottom of the complex.

The particular form of the cavities also facilitates the installation of monitoring sensors, for example temperature responsive means and level indicators, and the like. When the space is used as a machinery room, material transport can be effected with the aid of overhead cranes.

As beforementioned, the rock-mass can be sealed by injecting a sealing material through drill holes. This sealing material may be a silicone elastomer or the like.

Because the storage space is dry, it can also be used to store low radioactive and average radioactive nuclear waste deriving from nuclear power stations and nuclear research stations, in addition to the aforesaid products.

The rock cavity according to the present invention eliminates all problems known at present within the oil storage technique. The pumpability of oil stored compared with horizontal storage loaves provides a volumetric gain in storage facilitates which can be calculated in multi-million sums of currency in storage costs over an operational time of 20 years.

The method according to the invention affords the advantages of a rapid tunnel-driving method; precise contour drilling; optimal placement of injection holes; shot rock-mass can be removed independently of drilling; 80% of the drilled volume is coarse ring drilling; personnel need not enter the rock cavity, because of the presence of the vertical shafts; worker protection and ergonometry is improved by the vertical shafts; shorter construction times in comparison with conventional techniques; and lower blasting costs. The costs saving compared with conventional technique for a rock storage complex having a volumetric capacity of 500,000 $m^3$ can be estimated to be at least 20 MSEK.

We claim:

1. A method of constructing a substantially vertical, cylindrical rock cavity having a conical top part, a bottom part and a vertical part having a cross-section in the shape of a polygon comprising:

(a) forming from a transport tunnel an upper circumferential chamber having a radially inwardly extending chamber at a first level;

(b) forming from a further transport tunnel a lower circumferential chamber having a radially inwardly extending chamber at a second level;

(c) forming a vertical central shaft to connect the upper and lower radially inwardly extending chambers;

(d) forming at least three vertical shafts;

(e) ring drilling horizontally from the vertical central shaft;

(f) drilling horizontally from the vertical shafts, said horizontal drill holes being located to form said cross-section in the shape of a polygon;

(g) drilling angled holes from the vertical shafts so as to form a conical roof or ceiling arch; and (h) blasting upwards from below to form the vertical part of the rock cavity having the cross-section in the shape of a polygon wherein the upper and lower circumferential chambers have outer diameters greater than the substantially cylindrical part of the rock cavity, the first level is above the rock cavity, the second level is below the rock cavity and said at least three vertical shafts are formed at the periphery of the rock cavity.

2. The method of claim 1 further comprising forming drainage holes external to the rock cavity and opening into the vertical peripheral shafts.

3. The method of claim 1 further comprising drilling vertical holes downwardly from the upper circumferential chamber through rock located exterior to the rock cavity and injecting the holes with a water-impervious substance.

4. The method of claim 2 further comprising constructing a vertical wall in at least one of the vertical peripheral shafts to form a confined area into which the drainage holes discharge.

5. The method of claim 1 further comprising drilling from the vertical peripheral shafts to form a conical bottom part of the rock cavity.

* * * * *

UNITED STATES PATENT AND TRADEMARK OFFICE

CERTIFICATE OF CORRECTION

PATENT NO. : 4,708,523

DATED : November 24, 1987

INVENTOR(S) : Karl I. SAGEFORS & Per G. PERSSON

It is certified that error appears in the above-identified patent and that said Letters Patent is hereby corrected as shown below:

ON THE TITLE PAGE,
On line [45] DATE OF PATENT:, change "Nov. 24, 1981"

to --Nov. 24, 1987--.

Signed and Sealed this

Twenty-fourth Day of May, 1988

*Attest:*

DONALD J. QUIGG

*Attesting Officer*

*Commissioner of Patents and Trademarks*